US007637038B2

(12) United States Patent
Arzberger et al.

(10) Patent No.: US 7,637,038 B2
(45) Date of Patent: Dec. 29, 2009

(54) FOUNDATION CONSTRUCTION DEVICE FOR MAKING TRENCHES IN SOIL

(75) Inventors: Maximilian Arzberger, Igenhausen (DE); Ignaz Seitle, Karlshuld (DE); Ludwig Huber, Thalhausen (DE); Christian Herrmann, Altomünster (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 519 days.

(21) Appl. No.: 11/376,012

(22) Filed: Mar. 15, 2006

(65) Prior Publication Data

US 2006/0225308 A1 Oct. 12, 2006

(30) Foreign Application Priority Data

Mar. 18, 2005 (EP) ..... 05006038

(51) Int. Cl.
*E02F 5/08* (2006.01)

(52) U.S. Cl. ..... 37/91; 37/189; 299/34.11

(58) Field of Classification Search ..... 37/91, 37/92, 189, 190, 352, 357; 299/31, 34.11; 175/97, 98, 99
See application file for complete search history.

(56) References Cited

U.S. PATENT DOCUMENTS

| | | | | |
|---|---|---|---|---|
| 3,443,648 | A * | 5/1969 | Howard | 175/103 |
| 3,513,572 | A | 5/1970 | Novet | |
| 3,554,603 | A * | 1/1971 | Kampf-Emden et al. | 299/31 |
| 3,726,562 | A * | 4/1973 | Wharton, III | 299/12 |
| 3,879,088 | A * | 4/1975 | Sodder et al. | 299/31 |
| 3,894,587 | A * | 7/1975 | Sourice | 175/91 |
| 4,045,088 | A * | 8/1977 | Bechem | 299/31 |
| 4,102,415 | A * | 7/1978 | Cunningham | 175/96 |
| 4,247,222 | A * | 1/1981 | Schosek | 405/184 |
| 4,306,626 | A * | 12/1981 | Duke et al. | 173/35 |
| 4,312,541 | A * | 1/1982 | Spurgeon | 299/31 |
| 4,314,615 | A * | 2/1982 | Sodder et al. | 175/94 |
| 4,548,442 | A * | 10/1985 | Sugden et al. | 299/10 |
| 5,234,257 | A * | 8/1993 | Sugden et al. | 299/10 |
| 5,707,182 | A * | 1/1998 | Leffer | 405/267 |
| 6,076,290 | A * | 6/2000 | Seitle et al. | 37/398 |
| 6,431,653 | B1 * | 8/2002 | Kleuters | 299/31 |
| 6,446,364 | B1 * | 9/2002 | Herrero Codina | 37/187 |
| 6,793,444 | B2 * | 9/2004 | Kondo et al. | 405/259.3 |
| 7,143,843 | B2 * | 12/2006 | Doering et al. | 175/24 |
| 7,367,143 | B2 * | 5/2008 | Stoetzer | 37/189 |

FOREIGN PATENT DOCUMENTS

| | | | |
|---|---|---|---|
| DE | 3615068 | C1 | 10/1987 |
| DE | 43 09 233 | C1 | 7/1994 |
| DE | 198 38 513 | A1 | 4/1999 |
| DE | 698 21 726 | T2 | 12/2004 |
| EP | 0 518 298 | A1 | 12/1992 |
| EP | 0 593 355 | A1 | 4/1994 |
| EP | 05 00 6038 | | 11/2005 |
| FR | 2771429 | | 5/1999 |
| JP | 03194019 | | 8/1991 |
| JP | 06346446 | | 12/1994 |
| SU | 39720 | | 11/1934 |

* cited by examiner

*Primary Examiner*—Gary S Hartmann
(74) *Attorney, Agent, or Firm*—John A. Merecki; Hoffman Warnick LLC

(57) ABSTRACT

The invention relates to a foundation construction device for making trenches in the soil comprising a frame, on which a soil-removing tool is arranged, and a control device for aligning the foundation construction device in the trench having two control flaps, which are supported pairwise opposite each other on the frame, and having at least one extendable and retractable guide wheel arranged on the frame.

9 Claims, 5 Drawing Sheets

35
27
26
27
1
22
20
22
16
18
16
18
19
17
20
26
27
24
22
35

FOUNDATION CONSTRUCTION DEVICE FOR MAKING TRENCHES IN SOIL

FIELD OF THE INVENTION

The invention relates to a foundation construction device for making trenches in the soil comprising a frame, at least one soil-removing tool arranged on the frame and a control device for controlling the foundation construction device in the trench.

BACKGROUND ART

Such foundation construction devices for making trenches are lowered on a carrier device whilst being suspended thereon. Through rotating movements of cutting wheels, grabs or scoops the soil is removed in a generally rectangular cross-sectional surface so that a trench filled with suspension is produced in the soil. In order to make a trench wall this procedure can be repeated in a horizontally spaced position.

The soil can consist of different sand layers, stone layers, rock and cavities. This can give rise to undesirable deviations of the foundation construction devices. Even minor changes of direction of the foundation construction device may, in greater trench depths, lead to considerable gaps in the trench wall.

From DE-C-36 15 068 a cable-guided trench wall grab is known, on the grab frame of which a guide frame is longitudinally movable on the outside. The guide frame is lowered with the grab into the trench where it is braced against the walls of the trench by means of extendable spacer plates. In the guide frame the grab frame can be guided in the vertical direction during the movements required to strip the soil. In doing so the bracing of the guide frame in the trench is controlled such that the grab axis is always located in the centre of the trench. To this end the spacer plates are extended on either side of the grab axis equidistant thereto either by means of levers actuated through cylinder-piston units or directly by cylinder-piston units that can be controlled separately for each spacer plate. By using displacement measuring devices that indicate the position of the cylinder-piston units and an inclination measuring instrument that indicates the position of the grab frame to the vertical line a position of the grab in the trench can be controlled to a certain degree.

From the disclosed document EP-A-0 518 298 a trench wall cutter and a cutting method for making trench walls with random angles of inclination are known. For this purpose control flaps are arranged on a vertically movable cutting frame, which, by projecting as far as beyond the outer border of the cutting frame, can be driven through hydraulic cylinders. In the cutting frame an inclinometer is arranged for directional correction. The hydraulic cylinders can in addition have a displacement pick-up und a pressure switch for the position of the control flaps. The control flaps can be prestressed against the trench wall either at the lower end or at the upper end thereof, whereby a torque acting in a predetermined direction on the cutting frame is generated.

SUMMARY OF THE INVENTION

The invention is based on the object to provide a foundation construction device having a simple design which can be controlled in a precise and reliable manner in the trench.

In accordance with the invention the object is solved by a device having the features of claims 1 or 7. Preferred embodiments are stated in the dependent claims.

The foundation construction device according to the invention for making trenches in the soil is characterized in that the control device has at least two control flaps, which are supported pairwise opposite each other on the frame and are movable by means of at least one common adjusting cylinder, a lever mechanism and a distributing device, and in that the distributing device is designed to variably distribute the force and/or the adjusting path of the at least one common adjusting cylinder to the control flaps disposed opposite each other.

A basic idea of the invention resides in the fact that the soil-removing tool is guided along the previously produced trench wall according to a predetermined work path and that the soil-removing tool is re-aligned into a desired position in the case of an undesired deviation occurring. For the alignment opposite control flaps can be extended to a different degree by means of an adjusting cylinder. The force and/or the adjusting path of the adjusting cylinder are distributed to a varying extent to the control flaps by means of a controllable distributing device. As a result, the design of the foundation construction device is simplified whilst still maintaining a good controllability.

A preferred embodiment of the invention resides in that the lever mechanism is designed as a knee-lever mechanism having two articulated levers, each of which is linked to a control flap. Through the knee-lever mechanism the articulated levers can be pivoted at an equal distance or at a varying one so that the linked control flaps can be extended at an equal distance or at a varying one from the centre and at an equal distance or offset to each other in the vertical height.

According to the invention a further development resides in that the distributing device has a control member which is arranged in an adjustable manner, more particularly in a turnable manner, between the articulated levers and the at least one adjusting cylinder. In accordance with the position of the control member it transmits the force or the adjusting movement of the piston of the adjusting cylinder to the articulated levers.

According to an embodiment of the invention it is preferred that the control member is connected to an actuating rod, on which the at least one adjusting cylinder engages in an offset manner to a centre axis of the actuating rod. As a result of the offset engagement of the adjusting cylinder with respect to the centre axis of the actuating rod this actuating rod can be turned by the adjusting cylinder itself.

A particularly preferred further development of the invention resides in the fact that two adjusting cylinders are provided which engage on the actuating rod at different positions. The adjusting cylinders engage on opposite sides of the actuating rod on lever arms so that when the pistons are extended from the adjusting cylinders it is not only possible that the rod can be turned about its own axis but also that the forces are applied in an oblique downward directed manner.

Furthermore, a preferred embodiment of the invention resides in that on both sides of the actuating rod a control member is each arranged, with at least four control flaps being operable. Through the respective control member a displacement and/or a turning of the actuating rod is transmitted to the pivoting movement of the articulated levers.

Moreover, the foundation construction device according to the invention for making trenches in the soil is also characterized in that the control device has at least one guide wheel which is arranged on the frame in an extendable and retractable manner. The at least one guide wheel is located on the side of the foundation construction device that extends perpendicularly to the sides of the control flaps. The guide wheel serves to support the foundation construction device laterally on the trench wall and can be employed for the lateral correction of the position of the foundation construction device.

A preferred embodiment of the invention resides in that the guide wheel is rotatably supported on a swivel arm which can be pivoted through an actuating member. The swivel arm is pivotably supported on the frame on the other end with respect to the end where the guide wheel is rotatably supported. As actuating member e.g. an adjusting cylinder can be employed.

In accordance with the invention a further development resides in that a guide wheel is each arranged on two opposite sides. The guide wheels can be pivoted to the same extent or to a varying one through the swivel arm. As a consequence, during the production of the trench a defined lateral displacement of the foundation construction device and therefore a precise correction of the position of the foundation construction device in the trench are rendered possible.

According to the invention the foundation construction device for making trenches in the soil is designed as a trench wall cutter or a trench wall grab. These require a particularly precise guidance.

BRIEF DESCRIPTION OF THE DRAWINGS

In the following the invention will be described further by way of preferred embodiments which are schematically shown in the drawings.

DETAILED DESCRIPTION OF THE INVENTION

Figure 1:
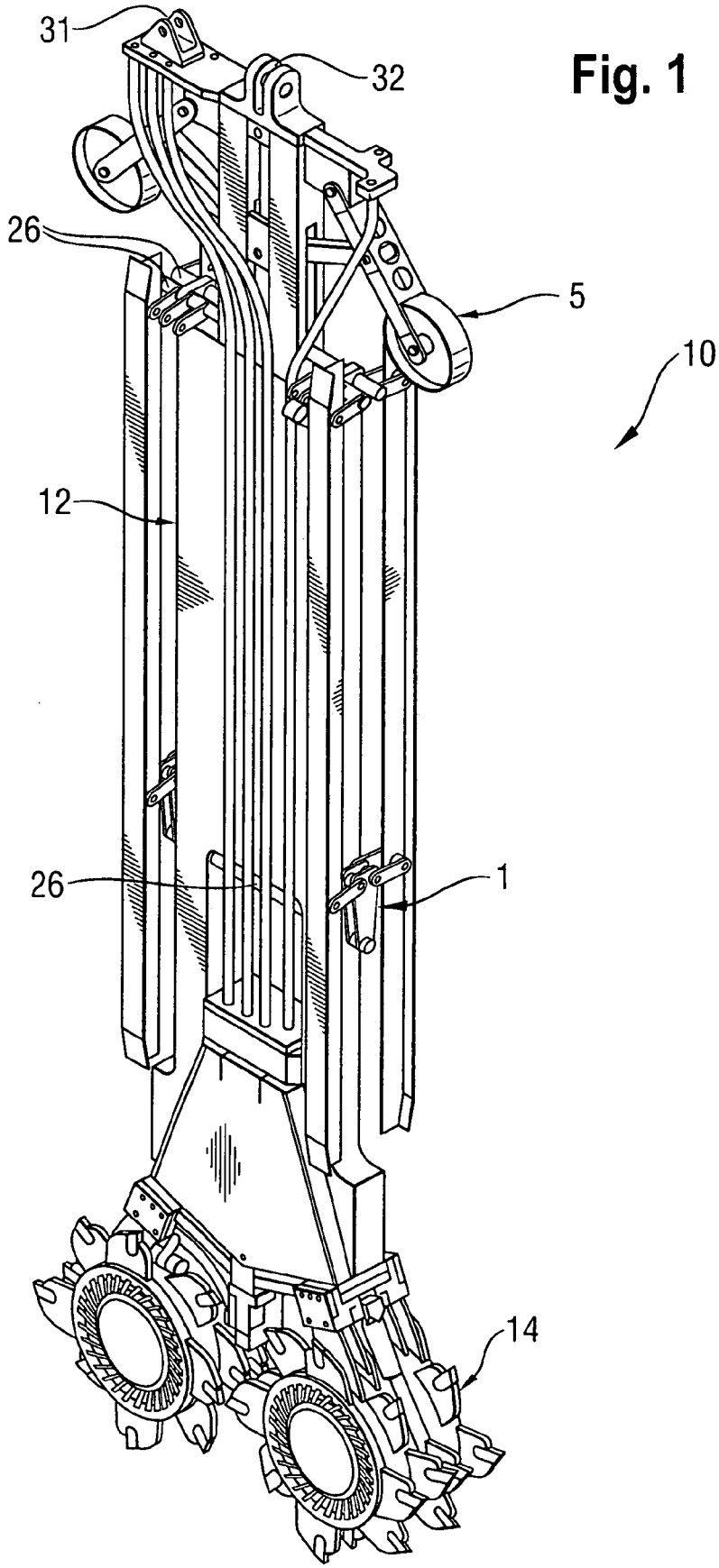
FIG. 1 shows a perspective view of a foundation construction device according to the invention.

In FIG. 1 a foundation construction device 10 according to the invention is shown which is designed in this case as a trench wall cutter. It includes several rotatably driven cutting wheels as soil-removing tools 14, a frame 12 and a control device comprising a control flap device 1 and a guide wheel device 5. For the attachment to cable mountings two bolts located in attachment slots 31, 32 are provided. Upon an increasing depth of the trench first the control flap device 1 and then the guide wheel device 5 can be additionally employed for guidance or for correcting the direction of the soil-removing tool.

Figure 2:
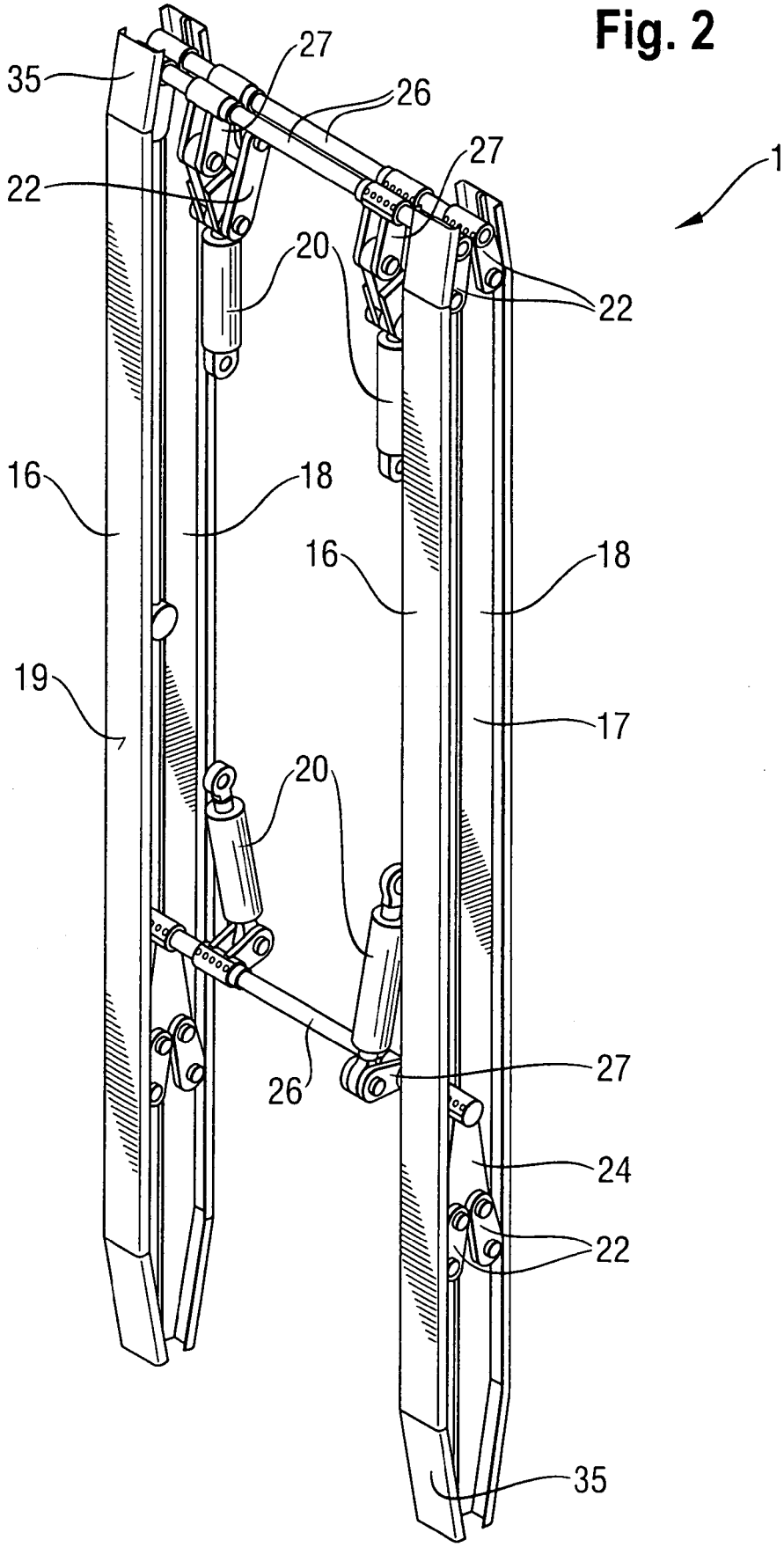
FIG. 2 shows a perspective view of a variant of a control flap device according to the invention when located in the retracted position.
Figure 3:
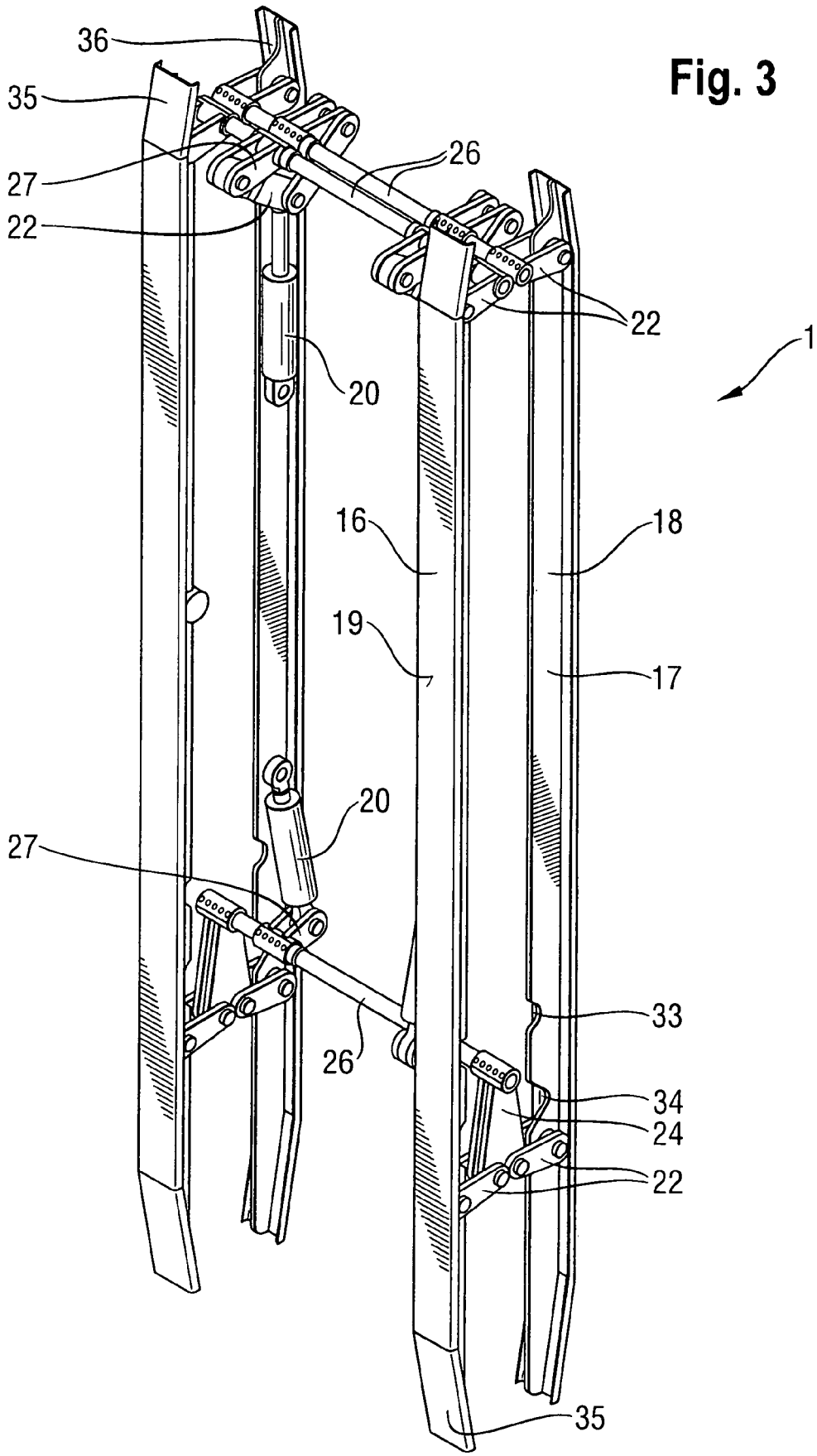
FIG. 3 shows a perspective view of the variant of the control flap device according to the invention from FIG. 2 when located in the extended position.

In FIGS. 2 and 3 a preferred variant of the control flap device in accordance with the invention is shown in perspective view. The control flap device 1 consists of a pair of two control flaps 16, 18 disposed opposite each other with their rear, adjusting cylinders 20 attached to the frame 12 on a side thereof, actuating rods 26 having lever arms 27 and lever mechanisms. The control flap 16, 18 has a flap contact surface 19, at the end of which end inclinations 35 are formed. The contact surfaces 19 rest against the trench wall for directional correction. At the rear of the control flap 16, 18 the said flap 16 and 18 respectively has a central, perpendicularly disposed control flap ridge 17, to which the articulated levers 22 are linked. In addition, a V-shaped ridge indentation 34 is provided for the articulated lever 22 in its retracted position as well as a U-shaped ridge indentation 33 and respectively a ridge sloping 36 is provided for the actuating rods 26 in their retracted position.

When the pistons of the upper adjusting cylinders 20 are extended, the upper knee-lever, consisting of the articulated lever 22 and the lever arm 27, causes the two actuating rods 26 together with the upper ends of the control flaps 16, 18 to be pressed apart.

When the two pistons of the lower adjusting cylinders 20, by being extended in an equal manner, exert an oblique, downward directed pressure predetermined by the lever arms 27, the lower actuating rod 26 moves downwards and extends the lower ends of the control flaps 16, 18.

If, through its extension, a single piston of a lower adjusting cylinder 20 exerts further pressure onto the lever arm 27, while the piston of the other adjusting cylinder stops, the control member 24 is turned as a result of the force acting outwards and downwards in an oblique manner. Consequently, the articulated levers 22 have a different angle of attack with respect to the plate-shaped control member 24, which leads to a different distribution of force to the articulated levers 22.

For the retraction of the control flaps 16, 18 the pistons of the lower adjusting cylinders 20 are retracted again, whereby the actuating rod and with it the control member 24 are lifted.

Figure 3A:
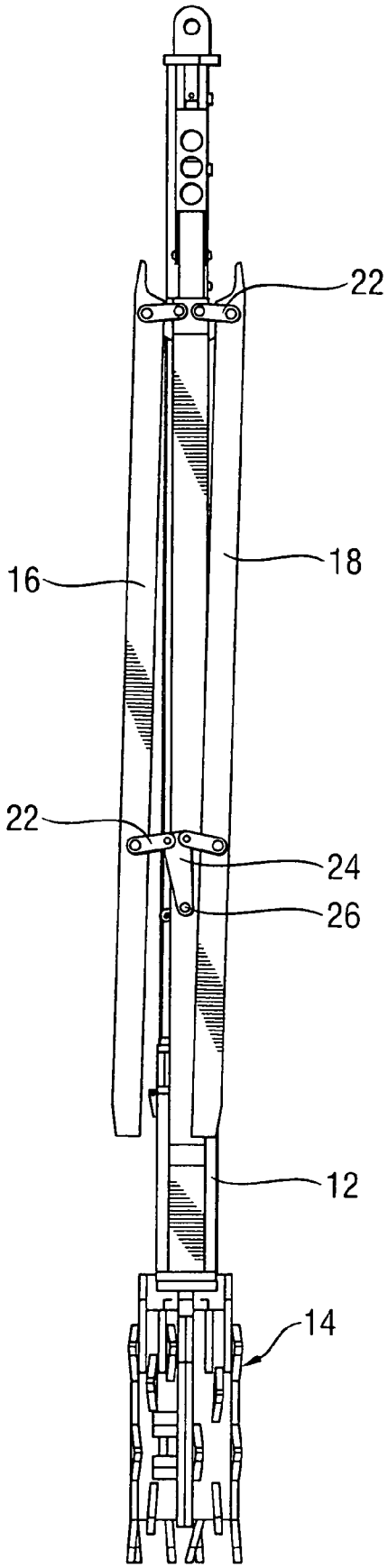
FIG. 3*a* shows a lateral view of the foundation construction device according to the invention from FIG. 1 during the correction of an obliquely cut trench.

In FIG. 3*a* an inclined position of the control flaps 16, 18 with respect to the frame 12 with the soil-removing tool 14 is shown in a lateral view of the foundation construction device from FIG. 1. In this case only the lower actuating rod 26 and the control member 24 located below the lower articulated levers 22 are operated. Through the turning and/or displacement of the actuating rod 26 the control member 24 linked to the articulated levers 22 has been adjusted too.

Figure 4:
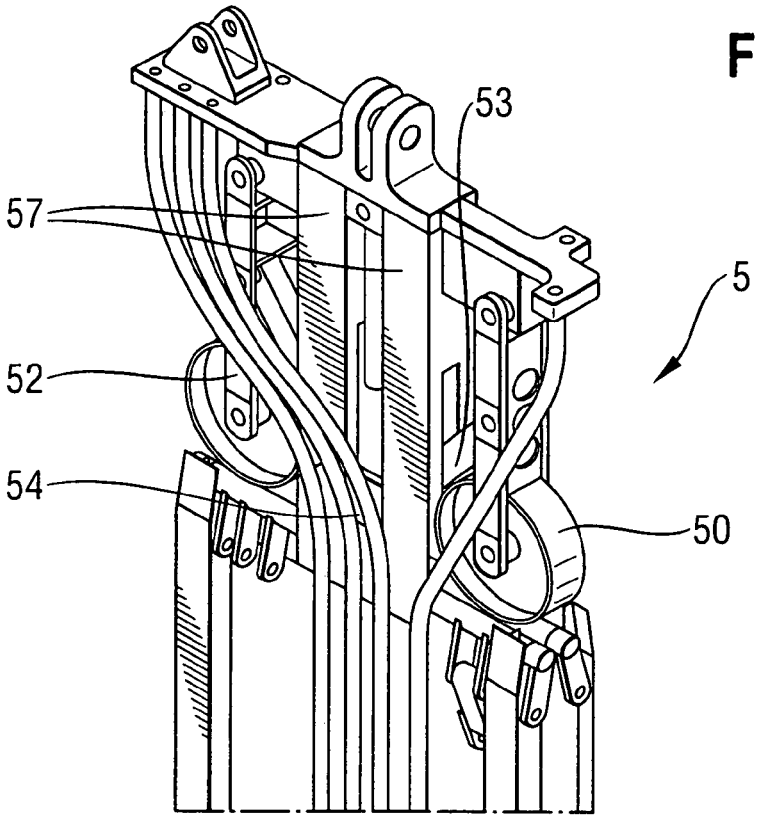
FIG. 4 shows a perspective partial view of a foundation construction device according to the invention with a guide wheel device located in the retracted position.
Figure 5:
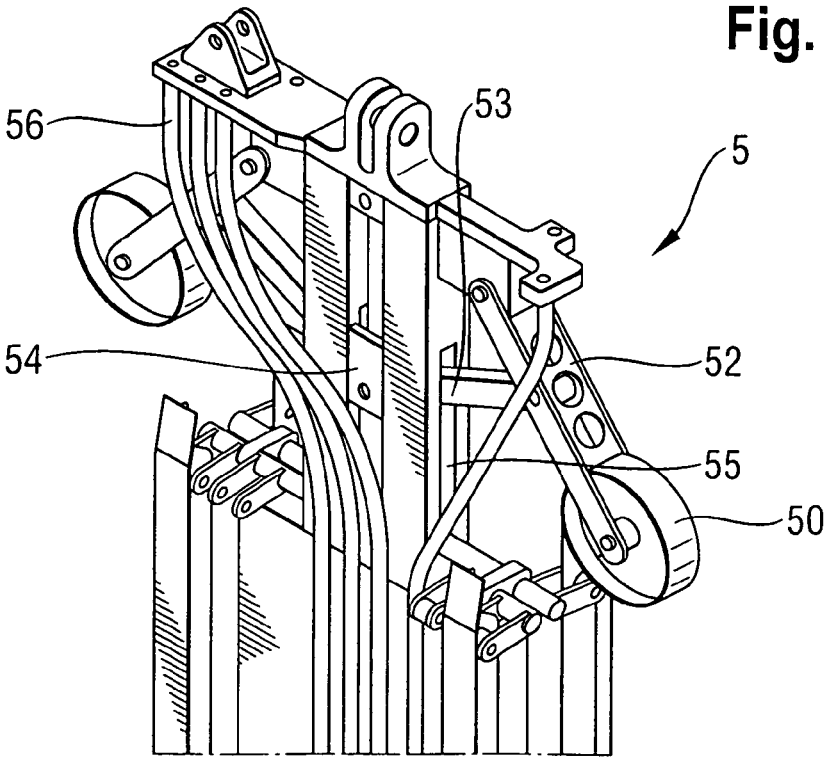
FIG. 5 shows a perspective partial view of the foundation construction device according to the invention with the guide wheel device from FIG. 4 located in the extended position.

In FIGS. 4 and 5 a guide wheel device 5 according to the invention is illustrated in a perspective view. While the control flap device 1 aligns the foundation construction device on its front and rear on the trench wall, the guide wheel device 5 is able to guide or align the foundation construction device on its sides on the trench wall. The guide wheel device 5 comprises guide wheels 50 that are rotatably supported on the swivel arms 52, pressing rods 53 that extend obliquely upwards and are each displaceable in a rod guide groove 55 of the frame posts 57 up to an upper stop, and a carriage 54 guided between two frame posts 57, to which the two pressing rods are linked. If the carriage 54 is for example moved upwards through the piston of a cylinder, the pressing rods 53 linked to the carriage 54 extend along a rod guide groove 55 in a horizontally positioned direction. In doing so the swivel arm 52, which is linked to the other side of the pressing rod 53 and is also linked to the frame 12, is pivoted laterally in an obliquely upward directed manner. Once the carriage 54 is moved downwards again, the swivel arms 52 with the guide wheels 50 are lowered back into the vertical position.

The invention claimed is:

1. Foundation construction device for making trenches in soil comprising a frame, at least one soil-removing tool arranged on the frame, and a control device for controlling the foundation construction device in a trench, wherein the control device has at least two control flaps for aligning the foundation construction device in the trench, which are supported pairwise opposite each other on the frame and are movable by means of at least two common adjusting cylinders, a lever mechanism and a distributing device, the distributing device variably distributing the force and/or the adjusting path of the at least two common adjusting cylinders to the control flaps disposed opposite each other, the lever mechanism comprises a knee-lever mechanism having two articulated levers, wherein one end of each articulated lever is linked to a corresponding one of the control flaps, and wherein the other end of each articulated lever is linked to a control member of the distributing device, the control member is connected to an actuating rod, on which the at least two adjusting cylinders engage in an offset manner to a center axis of the actuating rod, and the control member being arranged in an adjustable manner between the articulated levers and the at least two adjusting cylinders, such that the opposite control flaps can be extended to a different degree.

2. Foundation construction device according to claim 1, wherein two adjusting cylinders are provided which engage on the actuating rod at different positions.

3. Foundation construction device according to claim 1, wherein on both sides of the actuating rod a control member is each arranged, with at least four control flaps being operable.

4. Foundation construction device according to claim 1, wherein the foundation construction device is designed as a trench wall cutter or a trench wall grab.

5. Foundation construction device according to claim 1, wherein the control device has at least one guide wheel which is arranged on the frame in an extendable and retractable manner.

6. Foundation construction device according to claim 5, wherein the guide wheel is rotatably supported on a swivel arm which can be pivoted through an actuating member.

7. Foundation construction device according to claim 5, wherein a guide wheel is each arranged on two opposite sides.

8. Foundation construction device according to claim 5, wherein the foundation construction device is designed as a trench wall cutter or a trench wall grab.

9. Foundation construction device according to claim 1, wherein the frame is attached and mounted on a cable.

* * * * *